US011401577B2

(12) United States Patent
Blaise

(10) Patent No.: US 11,401,577 B2
(45) Date of Patent: Aug. 2, 2022

(54) MANUFACTURING PROCESS OF HOT PRESS FORMED ALUMINIZED STEEL PARTS

(71) Applicant: ArcelorMittal, Luxembourg (LU)

(72) Inventor: Alexandre Blaise, Montataire (FR)

(73) Assignee: ArcelorMittal, Luxembourg (LU)

( * ) Notice: Subject to any disclaimer, the term of this patent is extended or adjusted under 35 U.S.C. 154(b) by 471 days.

(21) Appl. No.: 16/465,298

(22) PCT Filed: Dec. 8, 2017

(86) PCT No.: PCT/IB2017/001531
§ 371 (c)(1),
(2) Date: May 30, 2019

(87) PCT Pub. No.: WO2018/115951
PCT Pub. Date: Jun. 28, 2018

(65) Prior Publication Data

US 2019/0345579 A1 Nov. 14, 2019

(30) Foreign Application Priority Data

Dec. 19, 2016 (WO) ..... PCT/IB2016/001774

(51) Int. Cl.

| | |
|---|---|
| ***C21D 11/00*** | (2006.01) |
| ***C21D 8/04*** | (2006.01) |
| ***C21D 9/48*** | (2006.01) |
| ***F27B 9/24*** | (2006.01) |
| ***F27B 9/36*** | (2006.01) |

(52) U.S. Cl.
CPC ..... *C21D 11/00* (2013.01); *C21D 8/04* (2013.01); *C21D 9/48* (2013.01); *F27B 9/24* (2013.01); *F27B 9/36* (2013.01)

(58) Field of Classification Search
CPC . C21D 11/00; C21D 8/04; C21D 9/46; C21D 9/48; F27B 9/24; F27B 9/36
USPC ..... 266/99, 249; 148/559, 277, 640, 113; 72/342.1, 364, 379.6
See application file for complete search history.

(56) References Cited

U.S. PATENT DOCUMENTS 6,207,299 B1 * 3/2001 Krauth ..... C23C 2/12 428/653
6,296,805 B1 * 10/2001 Laurent ..... C21D 8/0278 420/104
7,708,843 B2 * 5/2010 Laurent ..... C23C 2/26 148/518
8,066,829 B2 * 11/2011 Spehner ..... C22C 38/38 148/534
8,307,680 B2 * 11/2012 Drillet ..... C23C 2/40 72/47
8,733,142 B2 * 5/2014 Spehner ..... C23C 2/28 72/47

(Continued)

FOREIGN PATENT DOCUMENTS

CN 101545071 A 9/2009
CN 101910426 A 12/2010

(Continued)

OTHER PUBLICATIONS

International Search Report issued in connection with International application No. PCT/IB2017/001531 dated Apr. 4, 2018.
International Search Report issued in connection with International application No. PCT/IB2016/001774 dated Sep. 15, 2017.
International Preliminary Search Report issued in connection with International application No. PCT/IB2017/001531 dated Apr. 3, 2019.

*Primary Examiner* — Scott R Kastler
*Assistant Examiner* — Michael Aboagye
(74) *Attorney, Agent, or Firm* — Davidson, Davidson & Kappel, LLC

(57) ABSTRACT

A manufacturing process of a press hardened coated part including providing a furnace containing N zones, each furnace zone being respectively heated at a setting temperature $\Theta_{1F}, \Theta_{2F}, \ldots \Theta_{iF}, \ldots, \Theta_{NF}$, including: providing a steel sheet with thickness th between 0.5 and 5 mm, the steel sheet covered by an aluminium alloy precoating with a thickness between 15 and 50 μm, the emissivity coefficient being equal to $0.15(1+\alpha)$, $\alpha$ being between 0 and 2.4, then cutting the steel sheet to obtain a precoated steel blank, then placing the precoated steel blank in furnace zone 1 for a duration $t_1$ between 5 and 600 s, wherein $\Theta_{1F}$ and $t_1$ are such that: $\Theta_{1Fmax}>\Theta_{1F}>\Theta_{1Fmin}$ then transferring the precoated steel blank in the furnace zone 2 heated at a setting temperature $\Theta_{2F}=\Theta_{1B}$ and maintaining isothermally the precoated steel blank for a duration $t_2$, then transferring the precoated steel blank in further zones (3, . . . i, . . . , N) of the furnace, so to reach a maximum blank temperature $\Theta_{MB}$ between 850° C. and 950° C., the average heating rate $V_a$ of the blank between $\Theta_{2F}$ and $\Theta_{MB}$ being between 5 and 500° C./s, then hot forming the heated steel blank so as to obtain a part, then cooling the part to obtain martensite or bainite.

14 Claims, No Drawings

(56) References Cited

U.S. PATENT DOCUMENTS

| | | | | |
|---|---|---|---|---|
| 2009/0238715 | A1 | 9/2009 | Cho et al. | |
| 2010/0101690 | A1* | 4/2010 | Koga | C21D 9/46 148/567 |
| 2011/0006491 | A1 | 1/2011 | Spehner et al. | |
| 2012/0085467 | A1 | 4/2012 | Thirion et al. | |
| 2012/0097298 | A1 | 4/2012 | Sommer et al. | |
| 2013/0068350 | A1 | 3/2013 | Steins et al. | |
| 2013/0118646 | A1 | 5/2013 | Kobayashi et al. | |
| 2014/0030544 | A1 | 1/2014 | Maki et al. | |
| 2015/0314568 | A1 | 11/2015 | Takahashi et al. | |
| 2016/0017452 | A1 | 1/2016 | Puerta Velasquez et al. | |
| 2016/0076116 | A1 | 3/2016 | Baettenhausen et al. | |
| 2020/0399734 | A1* | 12/2020 | Blaise | C23C 2/40 |

FOREIGN PATENT DOCUMENTS

| | | | |
|---|---|---|---|
| CN | 102300707 | A | 12/2011 |
| CN | 104769138 | A | 7/2015 |
| CN | 204550669 | | 8/2015 |
| EP | 2133436 | A1 | 12/2009 |
| RU | 2563421 | C2 | 9/2015 |
| RU | 2603762 | C2 | 11/2016 |
| WO | WO9805943 | A1 | 2/1998 |
| WO | 2008053273 | A1 | 5/2008 |
| WO | WO2012026442 | | 3/2012 |
| WO | 2016079565 | A1 | 5/2016 |

* cited by examiner

MANUFACTURING PROCESS OF HOT PRESS FORMED ALUMINIZED STEEL PARTS

FIELD OF THE INVENTION

The invention relates to a process for manufacturing parts, starting from aluminized precoated steel sheets which are heated, press formed and cooled so as to obtain so-called press hardened or hot press formed parts. These parts are used for ensuring anti-intrusion or energy-absorption functions in cars or trucks vehicles.

BACKGROUND

For the manufacturing of recent Body-in-White structures in the automotive industry, the press hardening process (also called hot stamping or hot press forming process) is a growing technology for the production of steel parts with high mechanical strength which make it possible to increase the safety and the weight reduction of vehicles.

The implementation of press hardening using aluminized precoated sheets or blanks is known in particular from the publications FR2780984 and WO2008053273: a heat treatable aluminized steel sheet is cut to obtain a blank, heated in a furnace and rapidly transferred into a press, hot formed and cooled in the press dies. During the heating in the furnace, the aluminum precoating is alloyed with the iron of the steel substrate, thus forming a compound ensuring the protection of the steel surface against decarburization and scale formation. This compound allows the hot forming in the press. The heating is performed at a temperature which makes it possible to obtain partial or total transformation of the substrate steel into austenite. This austenite transforms itself during cooling caused by the heat transfer from the press dies, into microstructural constituents such as martensite and/or bainite, thus achieving structural hardening of the steel. High hardness and mechanical strength are thereafter obtained after press hardening.

In a typical process, a pre-coated aluminized steel blank is heated in a furnace during 3-10 minutes up to a maximum temperature of 880-930° C. in order to obtain a fully austenitic microstructure in the substrate and thereafter transferred within a few seconds into a press wherein it is immediately hot-formed into the desired part shape and simultaneously hardened by die quenching. Starting from a 22MnB5 steel, the cooling rate must be higher than 50° C./s if full martensitic structure is desired even in the deformed zones of the part. Starting from an initial tensile strength of about 500 MPa, the final press hardened part has a fully martensitic microstructure and a Tensile Strength value of about 1500 MPa.

As explained in WO2008053273, the heat treatment prior of the blanks prior to hot press forming is most frequently performed in tunnel furnaces, wherein blanks travel continuously on ceramic rollers. These furnaces are generally composed of different zones which are thermally insulated one from each other, each zone having its individual heating means. Heating is generally performed with radiant tubes or radiant electric resistances. In each zone, the setting temperature can be adjusted to a value which is practically independent from the other zone values.

The thermal cycle experienced by a blank travelling in a given zone is dependent on parameters such as the setting temperature of this zone, the initial temperature of the blank at the entry of the considered zone, the blank thickness and its emissivity, and the travelling speed of the blank in the furnace. Problems may be experienced in the furnaces due to the melting of the precoating which can lead to the fouling of the rollers. As a consequence of the fouling, the production line has sometimes to be temporarily stopped for maintenance, which causes a reduction in the line productivity.

A regulation of the initial coating variation in a tight range (typically 20-33 microns aluminium precoating on each face) and a limitation of the heating rate reduces the risk of melting. However, in spite of the existence of general guidelines for the managing of the temperature cycles in the lines, some serious difficulty remains to choose the optimum treatment parameters.

More precisely, the hot stamping industry is faced to contradictory requests for selecting the best settings:

- on one hand, the risk of melting of the precoating can be lowered with the selection of slow heating rates and slow line speeds.
- on the other hand, a high line productivity requires high heating rates and high line speeds.

Thus there is a need for a manufacturing method which fully avoids the risk of melting of aluminium precoating while simultaneously offering the highest possible productivity.

Furthermore, as mentioned above, thermal cycles experienced by a blank in a furnace are depending on its initial emissivity. Settings of a line may be well suited to a steel blank with a certain initial value of emissivity. If another blank is sequentially provided with a different initial emissivity coefficient, the line settings may not be ideally suited for this other sheet. Thus, there is a need for a method which would make it possible to adapt simply and rapidly the settings in the furnace, taking into account the initial blank emissivity.

Furthermore, the precoated steel blank may have a thickness which is not uniform. This is the case of the so-called "tailored rolled blanks" which are obtained from cutting a sheet obtained by a process of rolling with an effort which is variable along the direction of the length of the sheet. Or this may be also the case of the so-called "tailored welded blanks" obtained by the welding of at least two sub-blanks of different thicknesses. For these blanks with a non-uniform thickness, there is a need for a method which would guide the heating of such blanks, for simultaneously avoiding the risk of melting and maximizing the heating rate.

SUMMARY OF THE INVENTION

The present invention provides a manufacturing process of a press hardened coated part comprising:

- providing a furnace (F) comprising N zones, N being not less than 2, each furnace zone 1, 2 . . . i, . . . , N being respectively heated at a setting temperature $\Theta_{1F}$, $\Theta_{2F}$, . . . $\Theta_{iF}$, . . . , $\Theta_{NF}$,
- implementing the following successive steps, in this order:
- providing at least one steel sheet with thickness th comprised between 0.5 and 5 mm, comprising a steel substrate covered by an aluminium alloy precoating with a thickness comprised between 15 and 50 micrometres, the emissivity coefficient at room temperature of the steel sheet being equal to $0.15(1+\alpha)$, $\alpha$ being comprised between 0 and 2.4, then
- cutting the steel sheet to obtain a precoated steel blank, then placing the precoated steel blank in furnace zone 1 for a duration $t_1$ comprised between 5 and 600 s, wherein $\Theta_{1F}$ and $t_1$ are such that:

$$\Theta_{1Fmax}>\Theta_{1F}>\Theta_{1Fmin}$$

with: $\Theta_{1Fmax}=(598+A\ e^{Bt1}+Ce^{Dt1})$ and $\Theta_{1Fmin}=(550+A'e^{B't1}+C'e^{D't1})$ A, B, C, D, A', B', C', D' being such that:

$A=(762\ e^{0.071\ th}-426\ e^{0.86\ th})\ (1-0.345\alpha)$ $B=(-0.031\ e^{-2.151\ th}-0.039\ e^{-0.094\ th})\ (1+0.191\alpha)$ $C=(394\ e^{0.193\ th}-434.3\ e^{-1.797\ th})\ (1-0.364\alpha)$ $D=(-0.029\ e^{-2.677\ th}-0.011\ e^{-0298\ th})\ (1+0.475\alpha)$ $A'=(625\ e^{0.123\ th}-476\ e^{-1.593\ th})\ (1-0.345\alpha)$ $B'=(-0.059\ e^{-2.109\ th}-0.039\ e^{-0.091\ th})\ (1+0.191\alpha)$ $C'=(393\ e^{0.190\ th}-180\ e^{-1.858\ th})\ (1-0.364\alpha)$ $D'=(-0.044\ e^{-2.915\ th}-0.012\ e^{-0.324\ th})\ (1+0.475\alpha)$ wherein $\Theta_{1E}$, $\Theta_{1Fmax}$ $\Theta_{1Fmin}$ are in ° Celsius, $t_1$ is in s., and th is in mm, and wherein the temperature of the precoated steel blank at the exit of the furnace zone 1t is $\Theta_{1B}$, then transferring said at least one precoated steel blank in said furnace zone 2 heated at a setting temperature $\Theta_{2F}=\Theta_{1B}$ and maintaining isothermally the precoated steel blank for a duration $t_2$, $\Theta_{2F}$ and $t_2$ being such that:

$$t_{2min}\geq t_2\geq t_{2max}$$

with: $t_{2min}=0.95t_2^*$ and $t_{2max}=1.05t_2^*$ with: $t_2^*=t_1^2(-0.0007th^2+0.0025th-0.0026)+33952-(55.52\times\Theta_{2F})$ wherein $\Theta_{2F}$ is in ° Celsius, $t_2$, $t_{2min}$, $t_{2max}$, $t_2^*$ are in s., and th is in mm, then transferring said at least one precoated steel blank in further zones (3, . . . i, . . . , N) of the furnace, so to reach a maximum blank temperature $\Theta_{MB}$ comprised between 850° C. and 950° C., the average heating rate $V_a$ of the blank between $\Theta_{2F}$ and $\Theta_{MB}$ being comprised between 5 and 500° C./s, then transferring the steel blank from the furnace into a press, then hot forming the heated steel blank in the press so as to obtain a part, then cooling the part at a cooling rate in order to obtain a microstructure in the steel substrate comprising at least one constituent chosen among martensite or bainite.

In one embodiment, the heating rate $V_a$ is between 50 and 100° C./s.

In another embodiment, the precoating comprises, by weight, 5-11% Si, 2-4% Fe, optionally between 0.0015 and 0.0030% Ca, the remainder being aluminium and impurities inherent in processing.

In one embodiment, the heating at rate $V_a$ is performed by infrared heating.

In another embodiment, the heating at rate $V_a$ is performed by induction heating.

In one embodiment, the steel blank has a thickness which is not constant and varies between $th_{min}$ and $th_{max}$, the ratio $th_{max}/th_{min}$ being ≤1.5, and the manufacturing process is implemented in the furnace zone 1 with $\Theta_{1F}$ and $t_1$ determined with $th=th_{min}$, and implemented in the furnace zone 2 with $\Theta_{2F}$ and $t_2$ determined with $th=th_{max}$.

In another embodiment, after the maintaining of the precoated steel blank in the furnace zone 2, and before transferring the precoated steel blank in the further zones of the furnace, the precoated steel blank is cooled down to room temperature, so to obtain a cooled coated steel blank.

In one embodiment, the cooled coated steel blank has a ratio $Mn_{surf}/Mn_s$ comprised between 0.33 and 0.60, $Mn_{surf}$ being the Mn content in weight % on the surface of the cooled coated steel blank, and $Mn_s$ being the Mn content in weight % of the steel substrate.

In one embodiment, the heating rate $V_a$ is higher than 30° C./s.

In an additional embodiment, the heating rate $V_a$ is obtained by resistance heating.

In one embodiment, a plurality of blanks batches having a thickness th are provided, wherein at least one ($B_1$) is a batch with $\alpha=\alpha_1$ and at least one is a batch ($B_2$) with $\alpha=\alpha_2$, wherein $\alpha_1\neq\alpha_2$, the batch ($B_1$)) is press hardened in process conditions ($\Theta_{1F}(\alpha_1)$, $t_1(\alpha_1)$, $\Theta_2(\alpha_1)$, $t_2(\alpha_1)$) chosen as in a manufacturing process of a press hardened coated part comprising:

providing a furnace (F) comprising N zones, N being not less than 2, each furnace zone 1, 2 . . . i, . . . , N being respectively heated at a setting temperature $\Theta_{1F}$, $\Theta_{2F}$, . . . $\Theta_{iF}$, . . . , $\Theta_{NF}$, implementing the following successive steps, in this order:

providing at least one steel sheet with thickness th comprised between 0.5 and 5 mm, comprising a steel substrate covered by an aluminium alloy precoating with a thickness comprised between 15 and 50 micrometres, the emissivity coefficient at room temperature of said steel sheet being equal to $0.15(1+\alpha)$, a being comprised between 0 and 2.4, then cutting said at least one steel sheet to obtain at least one precoated steel blank, then measuring the emissivity of said at least one precoated steel blank, then placing said at least one precoated steel blank in furnace zone 1 for a duration $t_1$ comprised between 5 and 600 s, wherein $\Theta_{1F}$ and $t_1$ are such that:

$$\Theta_{1Fmax}\geq\Theta_{1F}\geq\Theta_{1Fmin}$$

with: $\Theta_{1Fmax}=(598+A\ e^{Bt1}+Ce^{Dt1})$ and $\Theta_{1Fmin}=(550+A'e^{B't1}+C'e^{D't1})$ A, B, C, D, A', B', C', D' being such that:

$A=(762\ e^{0.071\ th}-426\ e^{0.86\ th})\ (1-0.345\alpha)$ $B=(-0.031\ e^{-2.151\ th}-0.039\ e^{-0.094\ th})\ (1+0.191\alpha)$ $C=(394\ e^{0.193\ th}-434.3\ e^{-1.797\ th})\ (1-0.364\alpha)$ $D=(-0.029\ e^{-2.677\ th}-0.011\ e^{-0298\ th})\ (1+0.475\alpha)$ $A'=(625\ e^{0.123\ th}-476\ e^{-1.593\ th})\ (1-0.345\alpha)$ $B'=(-0.059\ e-2.109\ th-0.039\ e\ 0.091\ th)\ (1+0.191\alpha)$ $C'=(393\ e^{0.190\ th}-180\ e^{-1.858\ th})\ (1-0.364\alpha)$ $D'=(-0.044\ e^{-2.915\ th}-0.012\ e^{-0.324\ th})\ (1+0.475\alpha)$ wherein $\Theta_{1F}$, $\Theta_{1Fmax}$ $\Theta_{1Fmin}$ are in ° Celsius, $t_1$ is in s., and th is in mm, and wherein the temperature of the precoated steel blank at the exit of the furnace zone 1 is $\Theta_{1B}$, then transferring said at least one precoated steel blank in said furnace zone 2 heated at a setting temperature $\Theta_{2F}=\Theta_{1B}$ and maintaining isothermally the precoated steel blank for a duration $t_2$, $\Theta_{2F}$ and $t_2$ being such that:

$$t_{2min}\geq t_2\geq t_{2max}$$

with: $t_{2min}=0.95t_2^*$ and $t_{2max}=1.05t_2^*$ with: $t_2^*=t_1^2(-0.0007th^2+0.0025th-0.0026)+33952-(55.52\times\Theta_{2F})$ wherein $\Theta_{2F}$ is in ° Celsius, $t_2$, $t_{2min}$, $t_{2max}$, $t_2$* are in s., and th is in mm, then transferring said at least one precoated steel blank in further zones (3, . . . i, . . . , N) of the furnace, so to reach a maximum blank temperature $\Theta_{MB}$ comprised between 850° C. and 950° C., the average heating rate $V_a$ of the blank between $\Theta_{2F}$ and $\Theta_{MB}$ being comprised between 5 and 500° C./s, then transferring the at least one heated steel blank from the furnace into a press, then hot forming said at least one heated steel blank in said press so as to obtain at least one part, then cooling said at least one part at a cooling rate in order to obtain a microstructure in said steel substrate comprising at least one constituent chosen among martensite or bainite, then the batch ($B_2$) is press hardened in process conditions ($\Theta_{1F}(\alpha_2)$, $t_1(\alpha_2)$, $\Theta_2(\alpha_2)$, $t_2(\alpha_2)$) chosen as in a manufacturing process of a press hardened coated part comprising:

providing a furnace (F) comprising N zones, N being not less than 2, each furnace zone 1, 2 . . . i, . . . , N being respectively heated at a setting temperature $\Theta_{1F}$, $\Theta_{2F}$, . . . $\Theta_{iF}$, . . . , $\Theta_{NF}$, implementing the following successive steps, in this order:

providing at least one steel sheet with thickness th comprised between 0.5 and 5 mm, comprising a steel substrate covered by an aluminium alloy precoating with a thickness comprised between 15 and 50 micrometres, the emissivity coefficient at room temperature of said steel sheet being equal to 0.15(1+α), a being comprised between 0 and 2.4, then cutting said at least one steel sheet to obtain at least one precoated steel blank, then measuring the emissivity of said at least one precoated steel blank, then placing said at least one precoated steel blank in furnace zone 1 for a duration $t_1$ comprised between 5 and 600 s, wherein $\Theta_{1F}$ and $t_1$ are such that:

$$\Theta_{1Fmax}>\Theta_{1F}>\Theta_{1Fmin}$$

with: $\Theta_{1Fmax}=(598+A\,e^{Bt1}+Ce^{Dt1})$ and $\Theta_{1Fmin}=(550+A'e^{B't1}+C'e^{D't1})$ A, B, C, D, A', B', C', D' being such that:

$A=(762\,e^{0.071\,th}-426\,e^{0.86\,th})\,(1-0.345\alpha)$ $B=(-0.031\,e^{-2.151\,th}-0.039\,e^{-0.094\,th})\,(1+0.191\alpha)$ $C=(394\,e^{0.193\,th}-434.3\,e^{-1.797\,th})\,(1-0.364\alpha)$ $D=(-0.029\,e^{-2.677\,th}-0.011\,e^{-0.298\,th})\,(1+0.475\alpha)$ $A'=(625\,e^{0.123\,th}-476\,e^{-1.593\,th})\,(1-0.345\alpha)$ $B'=(-0.059\,e^{-2.109\,th}-0.039\,e^{0.091\,th})\,(1+0.191\alpha)$ $C'=(393\,e^{0.190\,th}-180\,e^{-1.858\,th})\,(1-0.364\alpha)$ $D'=(-0.044\,e^{-2.915\,th}-0.012\,e^{-0.324\,th})\,(1+0.475\alpha)$ wherein $\Theta_{1F}$, $\Theta_{1Fmax}$ $\Theta_{1Fmin}$ are in ° Celsius, $t_1$ is in s., and th is in mm, and wherein the temperature of the precoated steel blank at the exit of the furnace zone 1 is $\Theta_{1B}$, then transferring said at least one precoated steel blank in said furnace zone 2 heated at a setting temperature $\Theta_{2F}=\Theta_{1B}$ and maintaining isothermally the precoated steel blank for a duration $t_2$, $\Theta_{2F}$ and $t_2$ being such that:

$$t_{2min}\geq t_2\geq t_{2max}$$

with: $t_{2min}0.95t_2$* and $t_{2max}=1.05t_2$* with: $t_2=t_1^2(-0.0007th^2+0.0025th-0.0026)+33952-(55.52\times\Theta_{2F})$ wherein $\Theta_{2F}$ is in ° Celsius, $t_2$, $t_{2min}$, $t_{2max}$, $t_2$* are in s., and th is in mm, then transferring said at least one precoated steel blank in further zones (3, . . . i, . . . , N) of the furnace, so to reach a maximum blank temperature $\Theta_{MB}$ comprised between 850° C. and 950° C., the average heating rate $V_a$ of the blank between $\Theta_{2F}$ and $\Theta_{MB}$ being comprised between 5 and 500° C./s, then transferring the at least one heated steel blank from the furnace into a press, then hot forming said at least one heated steel blank in said press so as to obtain at least one part, then cooling said at least one part at a cooling rate in order to obtain a microstructure in said steel substrate comprising at least one constituent chosen among martensite or bainite, the temperatures and duration times in furnace zones (3, . . . i, . . . N) are identical for ($B_1$) and ($B_2$).

In one embodiment, after cutting the steel sheet and before placing the precoated steel blank in the furnace zone 1, the emissivity of the precoated steel blank at room temperature is measured.

The invention also provides a cooled coated steel blank manufactured as described above, wherein the cooled coated steel blank has a ratio $Mn_{surf}/Mn_s$ comprised between 0.33 and 0.60, $Mn_{surf}$ being the Mn content in weight % on the surface of said cooled coated steel blank, and $Mn_s$ being the Mn content in weight % of the steel substrate.

The invention also provides a device for heating batches of blanks in view of manufacturing press hardened parts from the heated blanks, comprising:

a device for measuring on-line the initial emissivity of batches of blanks at room temperature before heating, placed before a furnace (F), which includes an infrared source directed towards the blanks to be characterized, and a sensor receiving the reflected flux so to measure the reflectivity, a furnace (F) comprising N zones, N being not less than 2, each furnace zone 1, 2 . . . i, . . . , N, having heating means ($H_1$, $H_2$ . . . $H_i$, $H_N$) for setting independently the temperature $\Theta_{1F}$, $\Theta_{2F}$, . . . $\Theta_{iF}$, . . . , $\Theta_{NF}$ within each furnace zone, a device for transferring continuously and successively the blanks from each zone i towards the zone i+1;

a computer device for calculating the values $\Theta_{1Fmax}$, $\Theta_{1Fmin}$, $t_{2min}$, $t_{2max}$ as in a manufacturing process of a press hardened coated part comprising:

providing a furnace (F) comprising N zones, N being not less than 2, each furnace zone 1, 2 . . . i, . . . , N being respectively heated at a setting temperature $\Theta_{1F}$, $\Theta_{2F}$, . . . $\Theta_{iF}$, . . . , $\Theta_{NF}$, implementing the following successive steps, in this order:

providing at least one steel sheet with thickness th comprised between 0.5 and 5 mm, comprising a steel substrate covered by an aluminium alloy precoating with a thickness comprised between 15 and 50 micrometres, the emissivity coefficient at room temperature of said steel sheet being equal to 0.15(1+α), a being comprised between 0 and 2.4, then cutting said at least one steel sheet to obtain at least one precoated steel blank, then measuring the emissivity of said at least one precoated steel blank, then placing said at least one precoated steel blank in furnace zone 1 for a duration $t_1$ comprised between 5 and 600 s, wherein $\Theta_{1F}$ and $t_1$ are such that:

$$\Theta_{1Fmax}>\Theta_{1F}>\Theta_{1Fmin}$$

with: $\Theta_{1Fmax}=(598+A\ e^{Bt1}+Ce^{Dt1})$ and $\Theta_{1Fmin}=(550+A'e^{B't1}+C'e^{D't1})$ A, B, C, D, A', B', C', D' being such that:

$A=(762\ e^{0.071\ th}-426\ e^{0.86\ th})\ (1-0.345\alpha)$ $B=(-0.031\ e^{-2.151\ th}-0.039\ e^{-0.094\ th})\ (1+0.191\alpha)$ $C=(394\ e^{0.193\ th}-434.3\ e^{-1.797\ th})\ (1-0.364\alpha)$ $D=(-0.029\ e^{-2.677\ th}-0.011\ e^{-\Theta 298\ th})\ (1+0.475\alpha)$ $A'=(625\ e^{0.123\ th}-476\ e^{-1.593\ th})\ (1-0.345\alpha)$ $B'=(-0.059\ e^{-2.109\ th}-0.039\ e^{-0.091\ th})\ (1+0.191\alpha)$ $C'=(393\ e^{0.190\ th}-180\ e^{1.858\ th})\ (1-0.364\alpha)$ $D'=(-0.044\ e^{-2.915\ th}-0.012\ e^{-0.324\ th})\ (1+0.475\alpha)$ wherein $\Theta_{1F}$, $\Theta_{1Fmax}$ $\Theta_{1Fmin}$ are in ° Celsius, $t_1$ is in s., and th is in mm, and wherein the temperature of the precoated steel blank at the exit of the furnace zone 1 is $\Theta_{1B}$, then transferring said at least one precoated steel blank in said furnace zone 2 heated at a setting temperature $\Theta_{2F}=\Theta_{1B}$ and maintaining isothermally the precoated steel blank for a duration $t_2$, $\Theta_{2F}$ and $t_2$ being such that:

$$t_{2min}\geq t_2\geq t_{2max}$$

with: $t_{2min}=0.95t_2^*$ and $t_{2max}=1.05t_2^*$ with: $t_2^*=t_1^2(-0.0007th^2+0.0025th-0.0026)+33952-(55.52\times\Theta_{2F})$ wherein $\Theta_{2F}$ is in ° Celsius, $t_2$, $t_{2min}$, $t_{2max}$, $t_2^*$ are in s., and th is in mm, then transferring said at least one precoated steel blank in further zones (3, . . . i, . . . , N) of the furnace, so to reach a maximum blank temperature $\Theta_{MB}$ comprised between 850° C. and 950° C., the average heating rate $V_a$ of the blank between $\Theta_{2F}$ and $\Theta_{MB}$ being comprised between 5 and 500° C./s, then transferring the at least one heated steel blank from the furnace into a press, then hot forming said at least one heated steel blank in said press so as to obtain at least one part, then cooling said at least one part at a cooling rate in order to obtain a microstructure in said steel substrate comprising at least one constituent chosen among martensite or bainite, a device for transmitting the calculated temperatures and implementing eventual modification of energy input in said heating means ($H_1$, $H_2$ . . . $H_i$, $H_N$) in order to adjust the setting temperatures $\Theta_{1F}$, $\Theta_{2F}$, . . . $\Theta_{iF}$, . . . , $\Theta_{NF}$ according to the calculated temperatures, if a variation of initial emissivity between the batches of blanks is detected.

The invention also provides uses of steel parts manufactured with a process as described above, for the fabrication of structural or safety parts of vehicles.

DETAILED DESCRIPTION

The invention will now be described in more details and illustrated by examples without introducing limitations.

In one embodiment, a steel sheet is provided, with a thickness ranging from 0.5 to 5 mm. Depending on its thickness, this sheet can be produced by hot rolling or hot rolling followed by cold rolling. Below the thickness 0.5 mm, it is difficult to manufacture press hardened parts fulfilling the stringent flatness requirements. Above a sheet thickness of 5 mm, there is a possibility that thermal gradients occur within the thickness, which can in turn cause microstructural heterogeneities.

The sheet is composed of a steel substrate precoated by an aluminum alloy. The steel of the substrate is a heat treatable steel, i.e. a steel having a composition which makes it possible to obtain martensite and/or bainite after heating in the austenite domain and further quenching.

As non-limiting examples, the following steel compositions expressed in weight percentage, can be used and make it possible to obtain different levels of tensile strength after press hardening:

0.06%≤C≤0.1%, 1.4%≤Mn≤1.9%, optional additions of Nb, Ti, B as alloying elements, the remainder being iron and unavoidable impurities resulting from the elaboration;

0.15%≤C≤0.5%, 0.5%≤Mn≤3%, 0.1%≤Si≤1%, 0.005%≤Cr≤1%, Ti≤0.2%, Al≤0.1%, S≤0.05%, P≤0.1%, B≤0.010%, the remainder being iron and unavoidable impurities resulting from the elaboration;

0.20%≤C≤0.25%, 1.1%≤Mn≤1.4%, 0.15%≤Si≤0.35%, ≤Cr≤0.30%, 0.020%≤Ti≤0.060%, 0.020%≤Al≤0.060%, S≤0.005%, P≤0.025%, 0.002%≤B≤0.004%, the remainder being iron and unavoidable impurities resulting from the elaboration;

0.24%≤C≤0.38%, 0.40%≤Mn≤3%, 0.10%≤Si≤0.70%, 0.015%≤Al≤0.070%, Cr≤2%, 0.25%≤Ni≤2%, 0.015%≤Ti≤0.10%, Nb≤0.060%, 0.0005%≤B≤0.0040%, 0.003%≤N≤0.010%, S≤0.005%, P≤0.025%, %, the remainder being iron and unavoidable impurities resulting from the elaboration.

In certain embodiments, the precoating is a hot-dip aluminium alloy, i.e. having an Al content higher than 50% in weight. A preferred precoating is Al—Si which comprises, by weight, from 5% to 11% of Si, from 2% to 4% of Fe, optionally from 0.0015 to 0.0030% of Ca, the remainder being Al and impurities resulting from the smelting. The features of this precoating are specifically adapted to the thermal cycles of the invention.

This precoating results directly from the hot-dip process. This means that no additional heat treatment is performed on the sheet directly obtained by hot-dip aluminizing, before the heating cycle which will be explained afterwards.

The precoating thickness on each side of the steel sheet is comprised between 15 and 50 micrometers. For a precoating thickness less than 15 micrometres, the alloyed coating which is created during the heating of the blank has an insufficient roughness. Thus, the adhesion of subsequent painting is low on this surface and the corrosion resistance is decreased.

If the precoating thickness is more than 50 micrometres, alloying with iron from the steel substrate becomes much more difficult in the external portion of the coating.

According to its specific composition and roughness, the emissivity a of the precoating may be comprised between 0.15 and 0.51. Taking a precoated sheet with an emissivity of 0.15 as a reference sheet, the emissivity range may be also expressed as: 0.15 (1+α), wherein α is comprised between 0 and 2.4.

Prior to the heating stage, the precoated sheet is cut into blanks whose shapes are in relation with the geometry of the final parts to be produced. Thus, a plurality of precoated steel blanks are obtained at this stage.

For achieving the results of the invention, the inventor has put in evidence that the heating stage preceding the transfer of the blanks in the press and further press hardening, has to be divided in three main specific steps:

In a first step, the blanks are heated for a duration $t_1$ in a zone 1 of a furnace having a setting temperature $\Theta_{1F}$.

In a second step, the blanks are isothermally maintained during a duration $t_2$ in a zone 2 of a furnace having a setting temperature $\Theta_{2F}$.

In a third step, the blanks are heated in further zones, up to an austenization temperature $\Theta_{MB}$.

These three steps will be explained in more details:

The blanks having a thickness th are positioned on rollers or other appropriate means which make it possible to translate them into a multi-zone furnace. Before entering the first zone of the furnace, the emissivity of the blanks is measured. According to experiments, the emissivity of the aluminum alloys of the precoating considered in the frame of the invention is found to be very close to the absorptivity, i.e. the capacity to absorb the energy at the temperature of the furnace. The emissivity can be measured either by an off-line method or by an on-line method.

The off-line method comprises the following steps: the blank is heated in a furnace at high temperature, for example in the range of 900° C.-950° C., during a time such as the blank finally reaches the furnace temperature $T_\infty$. The temperature T of the blank is measured by thermocouples. From the measurement, the emissivity as a function of temperature is computed using the following equation:

$$\varepsilon = \frac{th \cdot \rho \cdot C_p \frac{\partial T}{\partial t} - 2h(T_\infty - T)}{2\sigma(T_\infty^4 - T^4)}$$

wherein:

th is the blank thickness,

ρ is the volumic mass, $C_p$ is the thermal massic capacity, t is the time, h is the convection heat transfer coefficient, and σ is the Stefan-Boltzmann constant.

According to experiments, emissivity is practically constant between 20° C. and the solidus temperature of the precoating.

The emissivity can be measured alternatively by an on-line method, i.e. directly on the blanks which are introduced in the furnace, by a device using a sensor based on the total reflectivity measurement of the blank. A device known in itself, is described for example in the publication WO9805943, wherein a radiation emitted by an infrared source is reflected by the product to characterize. A sensor receives the reflected flux making it possible to measure the reflectivity and thus to derive the absorptivity and the emissivity of the blank.

The blanks are introduced in the first zone of the furnace and maintained in it for a duration $t_1$ comprised between 5 and 600 s. It is desired that at the end of the duration in the first zone, the surface of the precoated blank reaches a temperature $\Theta_{1B}$ comprises between 550° C. and 598° C. If the temperature is higher than 598° C., there is a risk that the precoating would melt because it is close to its solidus temperature and causes some fouling on the rollers. When the temperature is lower than 550° C., the duration for the diffusion between the precoating and the steel substrate would be too long and the productivity would be not satisfactory.

If the duration $t_1$ is lower than 5 s, it would be not be practically possible to reach the target temperature range of 550–598° C. in some situations, for example in case of high blank thickness.

If the duration $t_1$ is higher than 600 s, the productivity of the line would be insufficient.

During this heating step in the furnace zone 1, the composition of the precoating is slightly enriched by diffusion from the elements of the steel substrate, but this enrichment is much less important than the composition changes that will occur in the furnace zone 2.

In order to reach the temperature range of 550–598° C. at the blank surface, the inventor has put into evidence that the setting temperature $\Theta_{1F}$ of the furnace zone 1, has to be comprised between two specific values $\Theta_{1Fmin}$ and $\Theta_{1Fmax}$ which are defined by the expressions (1) and (2):

$$\Theta_{1Fmax}=(598+A\,e^{Bt1}+Ce^{Dt1}) \quad (1)$$

$$\Theta_{1Fmin}=(550+A'e^{B't1}+C'e^{D't1}) \quad (2)$$

In (1), A, B, C, D are defined by:

$A=(762\,e^{0.071\,th}-426\,e^{0.86\,th})\,(1-0.345\alpha)$ $B=(-0.031\,e^{-2.151\,th}-0.039\,e^{-0.094\,th})\,(1+0.191\alpha)$ $C=(394\,e^{0.193\,th}-434.3\,e^{-1.797\,th})\,(1-0.364\alpha)$ $D=(-0.029\,e^{-2.677\,th}-0.011\,e^{-0298\,th})\,(1+0.475\alpha)$ In (2), A', B', C', D' are defined by:

$A'=(625\,e^{0.123\,th}-476\,e^{-1.593\,th})\,(1-0.345\alpha)$ $B'=(-0.059\,e^{-2.109\,th}-0.039\,e^{-0.091\,th})\,(1+0.191\alpha)$ $C'=(393\,e^{0.190\,th}-180\,e^{-1.858\,th})\,(1-0.364\alpha)$ $D'=(-0.044\,e^{-2.915\,th}-0.012\,e^{-0.324\,th})\,(1+0.475\alpha)$ In these expressions, $\Theta_{1F}$, $\Theta_{1Fmax}$, $\Theta_{1Fmin}$ are in ° Celsius, $t_1$ is in s, and th is in mm.

Thus, the setting temperature $\Theta_{1F}$ is precisely selected according to the sheet thickness th, to the precoating emissivity c and to the duration $t_1$ in the first zone.

At the exit of the furnace zone 1, the temperature of the blank $\Theta_{1B}$ can be measured, preferably by a remote-sensing device such as a pyrometer. The blank is immediately transferred into another furnace zone 2 wherein the temperature is set to be equal to the measured temperature $\Theta_{1B}$.

The blank is then maintained isothermally in the zone 2 for a duration $t_2$ which is specifically defined: $t_2$ depends on the settings in the zone 1 ($\Theta_{1F}$, $t_1$) and on the blank thickness th, according to the following expressions:

$$t_{2min} \geq t_2 \geq t_{2max}$$

wherein: $t_{2min}=0.95t_2^*$ and $t_{2max}=1.05t_2$ and: $t_2=t_1^2(-0.0007th^2+0.0025th-0.0026)+33952-(55.52\times\Theta_{2F})$ (3)

wherein $\Theta_{2F}$ is in ° Celsius, $t_2$, $t_{2min}$, $t_{2max}$, $t_2$ are in s, and th is in mm.

During this step, the solidus temperature of the precoating changes since the precoating is progressively modified by the diffusion of elements from the substrate composition, and namely by iron and manganese. Thus, the solidus of the initial precoating, which is equal for example to 577° C. for a composition of 10% Si, 2% iron in weight, the remainder being aluminum and unavoidable impurities, is progressively increased with the enrichment in Fe and Mn in the precoating.

When the duration $t_2$ is higher than $t_{2max}$, the productivity is reduced and the interdiffusion of Al, Fe and Mn proceeds too much, which can lead to a coating with a decreased corrosion resistance due to the reduction in Al content.

When the duration $t_2$ is lower than $t_{2min}$, the interdiffusion of Al and Fe is insufficient. Thus, some uncombined Al can be present in the coating at the temperature $\Theta_{2F}$, meaning that the coating may become partially liquid and lead to the fouling of the furnace rollers.

At the end of the furnace zone 2, the process can be further implemented according two alternative routes (A) or (B):

- in the first route (A), the blank is transferred in the further zones of the furnace (3, . . . , N) and further heated
- in the second route (B), the blank is cooled down to room temperature, stored, and then further reheated.

In the route (A) the blank is heated from its temperature $\Theta_{1B}$ up to a maximal temperature $\Theta_{MB}$ comprised between 850° and 950° C. This temperature range makes it possible to achieve a partial or total transformation of the initial microstructure of the substrate into austenite.

The heating rate $V_a$ from $\Theta_{1B}$ up to $\Theta_{MB}$ is comprised between 5 and 500° C./s: if $V_a$ is less than 5° C./s, the line productivity requirement is not met. If $V_a$ is higher than 500° C.s, there is a risk that some regions which are enriched in gammagene elements in the substrate transform more rapidly and more completely into austenite than the other regions, thus after rapid cooling, some microstructural heterogeneity of the part is to be expected. In these heating conditions, the risk of undesired melting of the coating occurring on the rollers is considerably reduced since the previous steps 1 and 2 have made it possible to obtain a coating sufficiently enriched in Fe and Mn, the melting temperature of which is higher.

As an alternative route (B), the blank can be cooled from $\Theta_{1B}$ down to room temperature and stored as desired in such condition. Thereafter, it can be reheated in an adapted furnace in the same conditions than in route (A), i.e. with $V_a$ from $\Theta_{1B}$ up to $\Theta_{MB}$ comprised between 5 and 500° C./s. However, the inventors has evidenced that a heating rate $V_a$ higher than 30° C./s or even higher than 50° C./s, can be used without any risk of localized melting of the coating when, before such heating, the Mn of the base metal sheet has diffused to the surface of the coating to such an extent that the ratio $Mn_{surf}/Mn_s$ is higher than 0.33, $Mn_{surf}$ being the Mn content in weight % on the surface of the coating before the rapid heating, and $Mn_s$ being the Mn content in weight % of the steel substrate. $Mn_{surf}$ can be measured for example through Glow Discharge Optical Emission Spectroscopy, which is a technique known per se. It is possible to use induction heating or resistance heating for achieving the desired heating rates higher than 30 or 50° C./s. However; when $Mn_{surf}/Mn_s$ is higher than 0.60, the corrosion resistance is lowered since the Al content of the coating is too much decreased. Thus, $Mn_{surf}/Mn_s$ ratio must be comprised between 0.33 and 0.60. Furthermore, the high heating rate makes it possible to keep at a low level the hydrogen intake in the coating which occurs in the coating at temperatures in particular higher than 700° C. and which are detrimental since the risk of delayed fracture is increased in the press hardened part.

Whatever the chosen route (A) or (B), the heating step at $V_a$ can be performed advantageously by induction heating or by infrared heating, since these devices make it possible to achieve such heating rate when sheet thickness is in the range of 0.5 to 5 mm.

After the heating at $\Theta_{MB}$, the heated blank is maintained at this temperature so to obtain a homogeneous austenitic grain size in the substrate and extracted from the heating device. A coating is present at the surface of the blank, resulting from the transformation of the precoating by the diffusion phenomenon mentioned above. The heated blank is transferred into a forming press, the transfer duration Dt being less than 10 s, thus fast enough so to avoid the formation of polygonal ferrite before the hot deformation in the press, otherwise there is a risk that the mechanical strength of the press hardened part does not achieve its full potential according to the substrate composition.

The heated blank is hot formed in the press so to obtain a formed part. The part is then kept within the tooling of the forming press so as to ensure a proper cooling rate and to avoid distortions due to shrinkage and phase transformations. The part mainly cools by conduction through heat transfer with the tools. The tools may include coolant circulation so as to increase the cooling rate, or heating cartridges so as to lower cooling rates. Thus, the cooling rates can be adjusted precisely by taking into account the hardenability of the substrate composition through the implementation of such means. The cooling rate may be uniform in the part or may vary from one zone to another according to the cooling means, thus making it possible to achieve locally increased strength or ductility properties.

For achieving high tensile stress, the microstructure in the hot formed part comprises at least one constituent chosen among martensite or bainite. The cooling rate is chosen according to the steel composition, so as to be higher than the critical martensitic or bainitic cooling rate, depending on the microstructure and mechanical properties to be achieved.

In a particular embodiment, the precoated steel blank which is provided for implementing the process of the invention has a thickness which is not uniform. Thus, it is possible to achieve in the hot formed part the desired mechanical resistance level in the zones which are the most subjected to service stresses and to save weight in the other zones, thus contributing to the vehicle weight reduction. In particular, the blank with non-uniform thickness can be produced by continuous flexible rolling, i.e. by a process wherein the sheet thickness obtained after rolling is variable in the rolling direction, so to obtain a "tailored rolled blank". Alternatively, the blank can be manufactured through the welding of blanks with different thickness, so to obtain a "tailored welded blank".

In these cases, the blank thickness is not constant but varies between two extreme values $th_{min}$ and $th_{max}$. The inventor has evidenced that the invention has to be implemented by using $th=th_{min}$ in the expressions (1-2) above and by using $th=th_{max}$ in the expression (3) above. In other words, the settings in the furnace zone 1 must be adapted to the thinnest portion of the blank, and the settings in furnace zone 2 must be adapted to the thickest portion of the blank. However, the relative thickness difference between $th_{max}$ and $th_{min}$ must be not too great, i.e. $\leq 1.5$, otherwise the large difference in the heating cycles experienced could lead to some localized melting of the precoating. By doing so, the fouling of the rollers does not appear in the most critical areas, which were found to be the thinnest section in the furnace zone 1, and the thickest section in furnace zone 2, while still guaranteeing the most favourable conditions for productivity for the blank with variable thickness.

In another embodiment of the invention, the hot press forming line implements different batches of blanks with same thickness, but which have not the same emissivity from one batch to another. For example, a furnace line has to heat treat a first batch (B1) having an emissivity defined by $\alpha 1$, then another batch (B2) with an emissivity defined by $\alpha 2$ different from $\alpha 1$. According to various embodiments of the invention, the first batch is heated with furnace settings in zones 1 and 2 according to expressions (1-3) taking into account $\alpha 1$ Thus, the furnace settings are: $\Theta_{1F}((\alpha 1)$, $t_1(\alpha_1)$, $\Theta_2(\alpha 1)$, $t_2(\alpha 1)$. Thereafter, the batch (B1) is heated in the furnace zones (3, . . . i, . . . N) according to a selection of furnace settings (S1). Thereafter, the second batch (B2) is also heat treated with settings (S2) corresponding to expressions (1-3), i.e. with settings $\Theta_{1F}(\alpha 2)$, $t_1(\alpha 2)$, $\Theta_2(\alpha 2)$, $t_2(\alpha 2)$.

According to various embodiments of the present invention, even if the initial emissivity is different, the state of the coating (B2) at the end of zone 2 of the furnace is identical to the one of (B1). Thus, selecting for (B2) the settings (S2) guarantees that the press hardened parts fabricated through this process will have constant properties in the coating and in the substrate, in spite of variations in the initial blank emissivity.

According to various embodiments of the present invention, the process is advantageously implemented with a device comprising:

- a device for measuring continuously the emissivity of blanks at room temperature before heating, which includes preferably an infrared source directed towards the blanks to be characterized, and a sensor receiving the reflected flux so to measure the reflectivity.
- a furnace (F) comprising N zones, N being not less than 2, each furnace zone 1, 2 . . . i, . . . , N, having heating means (H1, H2 . . . Hi, HN) for setting independently the temperature Θ1F, Θ2F, . . . ΘiF, . . . , ΘNF within each furnace zone,
- a device for transferring continuously and successively the blanks from each zone i towards the zone i+1, which is preferably a conveyor using ceramics rollers,
- a computer device for calculating the values Θ1Fmax, Θ1Fmin, t2min, t2max according to the expressions (1-3),
- a device for transmitting the calculated temperatures and implementing eventual modifications of energy input in the heating means to obtain the calculated temperatures if a variation of emissivity is detected.

The invention will be now illustrated by the following examples, which are by no way limitative.

Example 1

Sheets of 22MnB5 steel, 1.5, 2 mm or 2.5 mm thick, have been provided with the composition of table 1. Other elements are iron and impurities inherent in processing.

TABLE 1

| Steel composition (weight %) | | | | | | | | | |
|---|---|---|---|---|---|---|---|---|---|
| C | Mn | Si | Al | Cr | Ti | B | N | S | P |
| 0.22 | 1.16 | 0.26 | 0.030 | 0.17 | 0.035 | 0.003 | 0.005 | 0.001 | 0.012 |

The sheets have been precoated with Al—Si through continuous hot-dipping. The precoating thickness is 25 m on both sides. The precoating contains 9% Si in weight, 3% Fe in weight, the remainder being aluminum and impurities resulting from smelting. The emissivity coefficient E at room temperature of the precoating of the sheets is defined by $\alpha=0$.

The sheet has been thereafter cut so to obtain precoated steel blanks.

A furnace including three zones has been provided, the setting temperatures of these zones being respectively $\Theta_{1F}$, $\Theta_{2F}$, $\Theta_{3F}$.

The setting temperatures of table 2 were applied in the zones 1 and 2 in the furnaces. At the end of the zones 1 and 2, the blank was heated from the temperature $\Theta_{2F}$ up to 900° C. and maintained for 2 minutes at this temperature, with an average heating rate $V_a$ of 10° C./s. After extraction from the furnace, the blank was hot-formed and rapidly cooled so to obtain a full martensitic microstructure. The tensile strength of the obtained parts is of about 1500 MPa.

Furthermore, a heating was performed in a furnace including only one zone (test R5).

The eventual presence of melting of the precoating has been assessed in the different tests and reported in table 2.

Tests I1-I3 are realized according to the conditions of various embodiments of the present invention, tests R1-R5 are reference tests which do not correspond to these conditions.

TABLE 2

| Heating cycles and obtained results | | | | | | | | |
|---|---|---|---|---|---|---|---|---|
| Test | Blank thickness [mm] | $\Theta_{1F}$ (° C.) | $t_1$ (s) | $\Theta_{1B}$ (° C.) | $\Theta_{2F}$ (° C.) | $t_2$ (s) | $\Theta_{MB}$ | Absence of melting of the precoating |
| I1 | 2 | 884 | 120 | 598 | 598 | 745 | 900 | Yes |
| I2 | 1.5 | 1003 | 60 | 598 | 598 | 750 | 900 | Yes |
| I3 | 1.5 | 970 | 60 | 580 | 580 | 1296 | 900 | Yes |
| R1 | 1.5 | 1003 | 60 | 598 | 598 | 300 | 900 | No |
| R2 | 1.5 | 1003 | 60 | 700 | 700 | 750 | 900 | No |
| R3 | 2 | 884 | 120 | 700 | 700 | 745 | 900 | No |
| R4 | 2.5 | 1003 | 60 | 428 | 598 | 750 | 900 | No |
| R5 | 1.5 | 900 | 300 | 900 | — | — | — | No |

The specimens treated in the conditions I1-I3 according to the invention, do not show melting of the precoating.

In the test R1, the setting temperatures $\Theta_{1F}$ and $\Theta_{2F}$ and duration $t_1$ are the same as in the test I2. However, as the duration $t_2$ is insufficient as compared to the condition tmin defined in the expressions (3) above, a melting of the precoating is experienced.

In the test R2, the setting temperature $\Theta_{2F}$ is higher than in test I2 and the duration $t_2$ is insufficient in view of the condition tmin defined in the expressions (3) above.

In the test R3, the setting temperature $\Theta_{2F}$ is higher than in test 13 and the duration $t_2$ is insufficient in view of the condition tmin defined in the expressions (3) above.

In the test R4, even if the setting temperatures and durations $t_1$ and $t_2$ are identical to the one of test I2, the thickness sheet is higher than in test I2 and the temperature $\Theta_{1B}$ is not in the range of 550–598° C. The duration $t_2$ is insufficient in view of the condition (3) defined above.

In the test R5, heating is performed in a furnace including only one zone, and melting of the precoating is also experienced since the invention conditions are not met.

Example 2

A first batch of precoated blanks with an aluminum precoating defined by $\alpha=0$ was provided. A second batch of steel blanks with an aluminum precoating defined by $\alpha=0.3$ was provided. Sheet thickness is 1.5 mm in the two cases, the composition of steel and of precoating being identical to the one of example 1. The precoating thickness is 25 m on both sides. The two batches of steel blanks have been processed successively in the same furnace, with the settings detailed in table 3. Thereafter, the blanks were heated with the same average heating rate $V_a$ of 10° C./s, up to 900° C., maintained 2 minutes, and thereafter hot-formed and rapidly cooled so to obtain a full martensitic microstructure. The setting conditions are according to the conditions of various embodiments of the present invention defined by the expressions (1-3):

TABLE 3

Heating cycles of sheets with different emissivity values

| Test | $\Theta_{1F}$ (° C.) | $t_1$ (s) | $\Theta_{1B}$ (° C.) | $\Theta_{2F}$ (° C.) | $t_2$ (s) | $\Theta_{MB}$ (° C.) | Absence of melting of the precoating |
|---|---|---|---|---|---|---|---|
| First batch $\alpha = 0$ | 1003 | 60 | 598 | 598 | 750 | 900 | Yes |
| Second batch $\alpha = 0.3$ | 932 | 60 | 598 | 598 | 750 | 900 | Yes |

In spite of the initial emissivity difference, examinations reveal that the microstructure of the final coating is the same in the hot press formed parts.

Thus, the process of the invention makes it possible to obtain structural coated parts which have features comprised within a tight range.

Example 3

Tailored welded blanks ("TWB") were provided, composed of two aluminized steel blanks with different thickness combinations presented in table 4. The blanks were assembled by Laser welding. The composition of the steel and of the precoating was identical to the one of example 1, the precoating thickness being 25 μm on both sides. The TWB was heated in a furnace with the settings of table 4.

The welded blanks were heated to 900° C. with a heating rate $V_a$ of 10° C./s, maintained 2 minutes, extracted from the furnace, hot-formed and rapidly cooled so to obtain a full martensitic microstructure.

TABLE 4

Heating cycles of Laser Welded Blanks with different thicknesses

| Trial | thickness | $th_{max}/th_{min}$ | $\Theta_{1F}$ (° C.) | $t_1$ (s) | $\Theta_{1B}$ (° C.) | $\Theta_{2F}$ (° C.) | $t_2$ (s) | $\Theta_{MB}$ (° C.) | Absence of melting of the precoating |
|---|---|---|---|---|---|---|---|---|---|
| I4 | $th_{min}$ = 1 mm $th_{max}$ = 1.5 mm | 1.5 | 724 | 120 | 598 | 598 | 740 | 900 | Yes |
| R6 | $th_{min}$ = 0.5 mm $th_{max}$ = 1 mm | 2 | 724 | 120 | 598 | 598 | 740 | 900 | No |
| R7 | $th_{min}$ = 1 mm $th_{max}$ = 2.5 mm | 2.5 | 956 | 120 | 598 | 598 | 741 | 900 | No |
| R8 | $th_{min}$ = 1 mm $th_{max}$ = 2.5 mm | 2.5 | 724 | 120 | 598 | 598 | 740 | 900 | No |

Underlined values: not corresponding to the invention

Trial 14 was performed according to the invention, thus the melting does not occur in the thin or the thick part of the welded blank.

In reference trials R6-R8, the ratio: $th_{max}/th_{min}$ is not according to the invention.

In trial R6, the furnace settings are the same than in I1. However, since the furnace settings in the zone 1 are not adapted to the thickness of 0.5 mm, the melting of this portion of the weld occurs in this zone.

In trial R7, the furnace settings in the zone 1 is adapted to the thickness of 2.5 mm, but not adapted to the thickness of 1 mm. Thus the melting of this latter portion of the weld occurs in this zone.

In trial R8, the furnace settings are the same than in I1. However, since the furnace settings in the zone 2 are not adapted to the thickness of 2.5 mm, the melting of this portion of the weld occurs during the further heating from $\Theta_{2F}$ to $\Theta_{MB}$.

Example 4

Steel blanks, 1.5 mm thick having the features presented in example 1, have been provided. The blanks have been processed in a furnace including only two heated zones 1 and 2. The blanks have been heated successively in these two zones according to parameters of table 5. Thereafter, the blanks have been cooled directly to room temperature and stored. At this step, the Mn content the surface of the coating, $Mn_{surf}$ has been determined through Glow Discharge Optical Emission Spectroscopy) Thereafter, the blanks have been resistance heated at 900° C. with an average heating rate $V_a$ of 50° C./s, maintained 2 minutes at this temperature, then hot-formed and rapidly cooled so to obtain a full martensitic microstructure. The presence of an eventual melting during this fast heating step was noted.

TABLE 5

Heating cycles and obtained results

| Test | $\Theta_{1F}$ (° C.) | $t_1$ (s) | $\Theta_{1B}$ (° C.) | $\Theta_{2F}$ (° C.) | $t_2$ (s) | $\Theta_{MB}$ | Absence of melting of the precoating | $Mn_{surf}/Mn_s$ |
|---|---|---|---|---|---|---|---|---|
| I5 | 1003 | 60 | 598 | 598 | 750 | 900 | Yes | 0.33 |
| I6 | 1003 | 60 | 598 | 598 | 1500 | 900 | Yes | 0.4 |
| R9 | 1003 | 60 | 598 | 598 | 530 | 900 | No | 0.3 |

Underlined values: not corresponding to the invention

Tests I5 and I6 were conducted according to the conditions of the invention, thus no melting occurs during the heating at 50° C./s. Furthermore, the corrosion resistance of the press hardened part was satisfactory.

In reference test R9, as the $Mn_{surf}/Mn_s$ ratio is insufficient, melting occurs during the heating at 50° C./s.

Thus, the steel parts manufactured according to the invention can be used with profit for the fabrication of structural or safety parts of vehicles.

What is claimed is:

1. A manufacturing process of a press hardened coated part comprising:

providing a furnace (F) comprising N zones, N being not less than 2, each furnace zone 1, 2 . . . i, . . . , N being respectively heated at a setting temperature $\Theta_{1F}$, $\Theta_{2F}$, . . . $\Theta_{iF}$, $\Theta_{NF}$, implementing the following successive steps, in this order:

providing at least one steel sheet with thickness th between 0.5 and 5 mm, the at least one steel sheet comprising a steel substrate covered by an aluminium alloy precoating with a thickness between 15 and 50 μm, the emissivity coefficient at room temperature of the at least one steel sheet being from 0.15 to 0.51, then cutting said at least one precoated steel sheet to obtain at least one precoated steel blank, then measuring the emissivity of said at least one precoated steel blank to determine the emissivity coefficient, the emissivity coefficient being equal to 0.15(1+α), then placing said at least one precoated steel blank in furnace zone 1 for a duration $t_1$ between 5 and 600 s, wherein $\Theta_{1F}$ and $t_1$ are such that:

$$\Theta_{1Fmax}>\Theta_{1F}>\Theta_{1Fmin}$$

with: $\Theta_{1Fmax}=(598+A\ e^{Bt1}+Ce^{Dt1})$ and $\Theta_{1Fmin}=(550+A'e^{B't1}+C'e^{D't1})$ A, B, C, D, A', B', C', D' being such that:

$A=(762\ e^{0.071\ th}-426\ e^{0.86\ th})\ (1-0.345\alpha)$, $B=(-0.031\ e^{-2.151\ th}-0.039\ e^{-0.094\ th})\ (1+0.191\alpha)$, $C=(394\ e^{0.193\ th}-434.3\ e^{-1.797\ th})\ (1-0.364\alpha)$, $D=(-0.029\ e^{-2.677\ th}-0.011\ e^{-0298\ th})\ (1+0.475\alpha)$, $A'=(625\ e^{0.123\ th}-476\ e^{-1.593\ th})\ (1-0.345\alpha)$, $B'=(-0.059\ e^{-2.109\ th}-0.039\ e^{-0.091\ th})\ (1+0.191\alpha)$, $C'=(393\ e^{0.190\ th}-180\ e^{-1.858\ th})\ (1-0.364\alpha)$, $D'=(-0.044\ e^{-2.915\ th}-0.012\ e^{-0.324\ th})\ (1+0.475\alpha)$, wherein $\Theta_{1F}$, $\Theta_{1Fmax}$ $\Theta_{1Fmin}$ are in ° Celsius, $t_1$ is in s., and th is in mm, and wherein the temperature of the at least one precoated steel blank at the exit of the furnace zone 1 is $\Theta_{1B}$, then transferring said at least one precoated steel blank in said furnace zone 2 heated at a setting temperature $\Theta_{2F}=\Theta_{1B}$ and maintaining isothermally the at least one precoated steel blank for a duration $t_2$, $\Theta_{2F}$ and $t_2$ being such that:

$$t_{2min}\geq t_2\geq t_{2max}$$

with: $t_{2min}=0.95t_2^*$ and $t_{2max}=1.05t_2^*$ with: $t_2^*=t_1^2(-0.0007th^2+0.0025th-0.0026)+33952-(55.52\times\Theta_{2F})$ wherein 02F is in ° Celsius, $t_2$, $t_{2min}$, $t_{2max}$, $t_2^*$ are in s., and th is in mm, then transferring said at least one precoated steel blank in further zones (3, . . . i, . . . , N) of the furnace, so to reach a maximum blank temperature $\Theta_{MB}$ between 850° C. and 950° C., the average heating rate $V_a$ of the blank between $\Theta_{2F}$ and $\Theta_{MB}$ being comprised between 5 and 500° C./s, then transferring the heated at least one precoated steel blank from the furnace into a press, then hot forming said heated at least one precoated steel blank in said press so as to obtain at least one part, then cooling said at least one part at a cooling rate in order to obtain a microstructure in said steel substrate comprising at least one constituent chosen among martensite or bainite.

2. A manufacturing process according to claim 1, wherein the heating rate $V_a$ is between 50 and 100° C./s.

3. A manufacturing process according to claim 1, wherein said precoating comprises, by weight, 5-11% Si, 2-4% Fe, optionally between 0.0015 and 0.0030% Ca, the remainder being aluminium and impurities inherent in processing.

4. A manufacturing process according to claim 1, wherein said heating is performed by infrared heating.

5. A manufacturing process according to claim 1, wherein said heating is performed by induction heating.

6. A manufacturing process according to claim 1, wherein said at least one precoated steel blank has a thickness which is not constant and varies between $th_{min}$, and $th_{max}$, the ratio $th_{max}/th_{min}$ being ≤1.5, and wherein said manufacturing process is implemented in said furnace zone 1 with $\Theta_{1F}$ and $t_1$ determined by $th=th_{min}$, and implemented in said furnace zone 2 with $\Theta_{2F}$ and $t_2$ determined by $th=th_{max}$.

7. A manufacturing process according to claim 1, wherein after the maintaining of the at least one precoated steel blank in said furnace zone 2, and before transferring said at least one precoated steel blank in the further zones of the furnace, the at least one precoated steel blank is cooled down to room temperature, so to obtain a cooled at least one precoated steel blank.

8. A manufacturing process according to claim 7, wherein the said cooled at least one precoated steel blank has a ratio $Mn_{surf}/Mn_s$ between 0.33 and 0.60, $Mn_{surf}$ being the Mn content in weight % on the surface of said cooled at least one precoated steel blank, and $Mn_s$ being the Mn content in weight % of the steel substrate.

9. A manufacturing process according to claim 7, wherein said heating rate $V_a$ is higher than 30° C./s.

10. A manufacturing process according to claim 9, wherein said heating is obtained by resistance heating.

11. A manufacturing process according to claim 1, wherein:

a plurality of blanks batches having a thickness th are provided, wherein at least one ($B_1$) is a batch with $\alpha=\alpha_1$ and at least one is a batch ($B_2$) with $\alpha=\alpha_2$, wherein $\alpha_1\neq\alpha_2$, said batch ($B_1$) is press hardened in process conditions ($\Theta_{1F}(\alpha_1)$, $t_1(\alpha_1)$, $\Theta_2(\alpha_1)$, $t_2(\alpha_1)$) chosen according to claim 1, then said batch ($B_2$) is press hardened in process conditions ($\Theta_{1F}(\alpha_2)$, $t_1(\alpha_2)$, $\Theta_2(\alpha_2)$, $t_2(\alpha_2)$) chosen according to claim 1, the temperatures and duration times in furnace zones (3, . . . i, . . . N) are identical for ($B_1$) and ($B_2$).

12. A manufacturing process according to claim 1, wherein, after cutting said at least one precoated steel sheet and before placing said at least one precoated steel blank in said furnace zone 1, the emissivity of said precoated steel blank at room temperature is measured.

13. A manufacturing process according to claim 3, wherein said precoating further comprises, by weight, between 0.0015 and 0.0030% Ca.

14. A manufacturing process according to claim 1, wherein the press hardened coated part is a structural or a safety part of vehicles.

* * * * *